US007711300B2

(12) United States Patent
Nakafuji et al.

(10) Patent No.: US 7,711,300 B2
(45) Date of Patent: May 4, 2010

(54) IMAGE FORMING APPARATUS

(75) Inventors: Atsushi Nakafuji, Ota-Ku (JP); Takashi Fujita, Yokohama (JP); Shin Kayahara, Yokohama (JP); Hiromitsu Takagaki, Yokohama (JP); Takashi Seto, Yokohama (JP); Katsuaki Miyawaki, Yokohama (JP); Kazumi Suzuki, Sunnto-gun (JP); Hirohmi Tamura, Ebina (JP)

(73) Assignee: Ricoh Company Ltd., Tokyo (JP)

( * ) Notice: Subject to any disclaimer, the term of this patent is extended or adjusted under 35 U.S.C. 154(b) by 167 days.

(21) Appl. No.: 11/857,579

(22) Filed: Sep. 19, 2007

(65) Prior Publication Data

US 2008/0069610 A1 Mar. 20, 2008

(30) Foreign Application Priority Data

Sep. 19, 2006 (JP) ..... 2006-253547

(51) Int. Cl.
*G03G 15/20* (2006.01)

(52) U.S. Cl. ..... 399/307; 399/148; 399/308

(58) Field of Classification Search ..... 399/307, 399/308, 148

See application file for complete search history.

(56) References Cited

U.S. PATENT DOCUMENTS 5,890,043 A * 3/1999 Uehara ..... 399/307
6,324,374 B1 11/2001 Sasamoto et al.
6,556,802 B2 4/2003 Sasamoto et al.
6,768,891 B2 7/2004 Sasamoto et al.
6,941,102 B2 9/2005 Sasamoto et al.
7,010,255 B2 3/2006 Yura et al.
7,031,648 B2 4/2006 Takashi et al.
7,127,202 B2 * 10/2006 Fujita et al. ..... 399/307
7,233,762 B2 * 6/2007 Kunii et al. ..... 399/307

(Continued)

FOREIGN PATENT DOCUMENTS

JP 10-063121 3/1998

(Continued)

OTHER PUBLICATIONS

U.S. Appl. No. 11/669,817, filed Jan. 31, 2007, Suzuki, et al.

(Continued)

*Primary Examiner*—David M Gray
*Assistant Examiner*—Barnabas T Fekete
(74) *Attorney, Agent, or Firm*—Oblon, Spivak, McClelland, Maier & Neustadt, L.L.P.

(57) ABSTRACT

An image forming apparatus includes an image carrier for bearing a visible image thereon, an endless transfer-fixing belt stretchedly disposed between a plurality of spanning members, a pressure member for pressing the transfer-fixing belt to the image carrier while contacting a backside of the transfer-fixing belt at the transfer nip, and a heater for heating the visible image. The visible image on the image carrier is transferred onto the front surface of the transfer-fixing belt at the transfer nip and is transported to the transfer-fixing nip while heated by the heater, where the visible image is transferred and fixed on a recording member. The transfer-fixing belt is stretchedly arranged such that the transfer-fixing belt travels in a direction substantially perpendicular to a pressure direction of the pressure member in the proximity of the transfer nip.

7 Claims, 7 Drawing Sheets

U.S. PATENT DOCUMENTS

| | | | | |
|---|---|---|---|---|
| 2006/0008302 | A1 | 1/2006 | Someya et al. | |
| 2006/0110191 | A1 * | 5/2006 | Amarakoon | 399/307 |
| 2006/0120776 | A1 * | 6/2006 | Takashi et al. | 399/307 |
| 2006/0140689 | A1 | 6/2006 | Echigo et al. | |
| 2007/0008395 | A1 | 1/2007 | Masubuchi et al. | |
| 2007/0065188 | A1 | 3/2007 | Takagaki et al. | |
| 2007/0071511 | A1 | 3/2007 | Suzuki et al. | |

FOREIGN PATENT DOCUMENTS

| | | |
|---|---|---|
| JP | 2003-195667 | 7/2003 |
| JP | 2004-037889 | 2/2004 |
| JP | 2004-145260 | 5/2004 |
| JP | 2005-189697 | 7/2005 |

OTHER PUBLICATIONS

U.S. Appl. No. 11/683,086, filed Mar. 7, 2007, Takemoto, et al.
U.S. Appl. No. 12/164,921, filed Jun. 30, 2008, Suzuki et al.
U.S. Appl. No. 12/144,078, filed Jun. 23, 2008, Kayahara et al.
U.S. Appl. No. 12/144,267, Jun. 23, 2008, Yasutomi, et al.

* cited by examiner

IMAGE FORMING APPARATUS

CROSS REFERENCE TO RELATED APPLICATIONS

This patent application is based on and claims priority under 35 U.S.C. §119 from Japanese Patent Application No. JP2006-253547 filed on Sep. 19, 2006 in the Japan Patent Office, the entire contents of which are incorporated herein by reference.

BACKGROUND OF THE INVENTION

1. Field of the Invention

Exemplary aspects of the present invention generally relate to an image forming apparatus, and more particularly to an image forming apparatus which transfers and fixes a visible image on a recording medium such as paper.

2. Discussion of the Background

Conventionally, it has been known that an image forming apparatus such as a copier, a facsimile and a printer forms an image on a recording medium, for example, a recording sheet in a following manner.

The visible image, for example, a toner image carried on an image carrier such as a photosensitive drum and an intermediate transfer medium is electrostatically transferred to the recording medium by the effect of the transfer electric field.

Subsequently, the recording sheet is nipped by a fixing nip formed by abutting a heating roller and a pressure roller, for example.

Accordingly, at least one of the abutting members is heated so that the temperature thereof is relatively high. The heat and the nip pressure of the abutting members act on the surface of the recording sheet nipped by the fixing nip. Accordingly, the visible image is fixed thereon.

With an advancement of a high-quality image in recent years, an enhancement of gloss on the visible image on the recording sheet has been desired.

Consequently, the fixing temperature tends to be high so that image forming materials are sufficiently fused, and the gloss of the visible image is enhanced.

In order to realize the fixing process at a high temperature, a fixing power source with a large output capacity is used. Consequently, an increase in an energy consumption and cost is most likely to occur.

Furthermore, the recording sheet is overheated at the fixing nip causing recording sheets to easily stick with one another at a sheet stacking portion.

Conventionally, an image forming apparatus which substantially heats a visible image prior to fixing the visible image on the recording sheet has been proposed.

In the related art image forming apparatus, the transfer-fixing roller abuts against a front surface of the intermediate transfer belt for transferring a toner image or a visible image formed on the photosensitive drum. Accordingly a secondary transfer nip is formed.

Furthermore, a transfer-fixing nip is formed by abutting a pressure roller against the secondary transfer nip. After the toner image primarily transferred from the photosensitive drum to the intermediate transfer belt is secondarily transferred to the surface of the transfer-fixing roller, the toner image is transported to the transfer-fixing nip in conjunction with rotation of the transfer-fixing roller.

At this time, a heater in the transfer-fixing roller or a heater disposed opposite to the transfer-fixing roller or the like substantially heats the toner image. In synchronization with the toner image on the transfer-fixing roller, the toner image is transferred and fixed on the recording sheet nipped by the transfer-fixing nip.

According to this configuration, the toner is heated separately from the recording sheet, and subsequently adhered to the recording sheet.

Thus, it may be able to prevent the recording sheet from being excessively heated and from sticking to a stack of recording sheets at the sheet stacking portion.

Furthermore, when the heater is disposed across from the transfer-fixing roller, it is possible to suppress a heat conduction to the transfer-fixing roller so that an energy consumption is reduced when compared with installation of the heater in the transfer-fixing roller.

However, according to the image forming apparatus configured in the above manner, when the temperature of the surface of the transfer-fixing roller is increased by the heater, and the surface thereof comes into contact with the intermediate transfer belt at the transfer nip described above, the intermediate transfer belt is heated by a small amount. Consequently, it is possible to promote deterioration of the intermediate transfer belt.

Another related art image forming apparatus using a transfer-fixing belt stretchedly arranged between a plurality of rollers instead of the transfer-fixing roller and endlessly travels has been proposed.

A heater disposed across from the transfer-fixing belt heats a toner image on the belt.

According to this configuration, after the belt surface heated by the heater advances to the transfer-fixing nip in order to transfer or fix the toner image on the recording sheet, it is possible to cool down the belt surface while traveling to the transfer nip.

Accordingly, it is possible to suppress deterioration of the intermediate transfer belt due to heat.

However, according to experiments performed by inventors of the present invention, in the image forming apparatus configured in the above-described manner, a disturbance or a hollow portion may easily be generated in the toner image when secondarily transferring the toner image from the intermediate transfer belt to the transfer-fixing belt. This phenomena is hereinafter referred to as a hollow defect.

In the image forming apparatus, the pressure roller in contact with the rear surface of the transfer-fixing belt presses the transfer-fixing belt against intermediate transfer belt so as to form a secondary transfer nip.

Conventionally, it has been known that when the pressure at the transfer nip, for example, a secondary transfer nip (hereinafter referred to as a fixing nip pressure) is excessively high, the hollow defect is most likely be generated in the toner image.

According to the above-described related art image forming apparatus, when the recording sheet is nipped by the transfer-fixing nip separately provided from the secondary transfer nip, a rapid stress is applied to the transfer-fixing belt, and thus a speed of the transfer-fixing belt slows down for a brief moment.

When the recording sheet is ejected from the transfer-fixing nip, the speed of the transfer-fixing belt increases for a brief moment due to the rapid decrease in the stress.

Consequently, when the speed of the transfer-fixing belt fluctuates, a tension of the transfer-fixing belt in the proximity of the secondary transfer nip temporarily fluctuates by a large amount.

As a result, with this configuration in which the transfer-fixing belt is stretchedly arranged in a proximity of the secondary transfer nip in a manner as illustrated in FIG. 1, for example, the belt tension in directions shown by arrows A or B temporarily fluctuates by a large amount due to the rapid fluctuation of the speed of the transfer-fixing belt 21.

When the tension in the directions A and B is loosened, the pressure of a pressure roller 24 in a direction shown by an arrow C may increase. Consequently, a nip pressure formed by abutting an intermediate transfer belt 11 serving as an image carrier and the transfer-fixing belt 21 increases.

As a result, the hollow defect is induced in the toner image.

SUMMARY OF THE INVENTION

In view of the foregoing, exemplary embodiments of the present invention provide an image forming apparatus which includes an image carrier, an endless transfer-fixing belt, a pressure member and a heater.

The image carrier bears a visible image on its surface which endlessly travels. The endless transfer-fixing belt is stretchedly disposed between a plurality of spanning members, and contact a front surface thereof to the image carrier so as to form a transfer nip while contacting another member other than the image carrier to form a transfer-fixing nip. The pressure member presses the transfer-fixing belt to the image carrier while contacting a backside of the transfer-fixing belt at the transfer nip. The heater heats the visible image.

The visible image on the image carrier is transferred onto the front surface of the transfer-fixing belt at the transfer nip and is transported to the transfer-fixing nip while heated by the heater, where the visible image is transferred and fixed on a recording member.

The transfer-fixing belt is stretchedly arranged such that the transfer-fixing belt travels in a direction substantially perpendicular to a pressure direction of the pressure member in the proximity of the transfer nip.

In one exemplary embodiment, the pressure member includes a curved surface having a specific curvature and contacting the transfer fixing belt.

In one exemplary embodiment, the following relationship is satisfied:

$$T_1 \sin \theta_1 + T_2 \sin \theta_2 < 2.5 \times S,$$

where $\theta_1$ [degree] is an angle between a first virtual line segment $L_1$ extending from a winding start point $P_1$ of the transfer-fixing belt relative to the curved surface of the pressure member to a center of a virtual circle having the same curvature as that of the curved surface, which is drawn along a curved direction of the curved surface, and a third virtual line segment $L_3$ extending from the center point of the transfer nip in the belt traveling direction to the center of the virtual circle; $\theta_2$ [degree] is an angle between a second line segment $L_2$ extending from a winding finish point $P_2$ of the transfer-fixing belt relative to the pressure member to the center of the virtual circle and the third line segment $L_3$; S [$cm^2$] is an area of the transfer nip; $T_1$ [N] is a tension near the winding start point $P_1$ of the transfer-fixing belt in the resting state; and $T_2$ [N] is a tension near the winding finish point $P_2$ of the transfer-fixing belt in the resting state.

In one exemplary embodiment, the winding start point $P_1$ is disposed upstream in the belt traveling direction further than a transfer nip entrance point where the image carrier and the transfer-fixing belt start contacting each other.

In one exemplary embodiment, the winding finish point $P_2$ is disposed downstream in the belt traveling direction further than a transfer nip exit point where the image carrier and the transfer-fixing belt start separating from each other after passing the transfer nip.

In one exemplary embodiment, the pressure member is a plate-shaped member curved at a specific curvature.

In one exemplary embodiment, the pressure member is formed of a material having a high stiffness.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
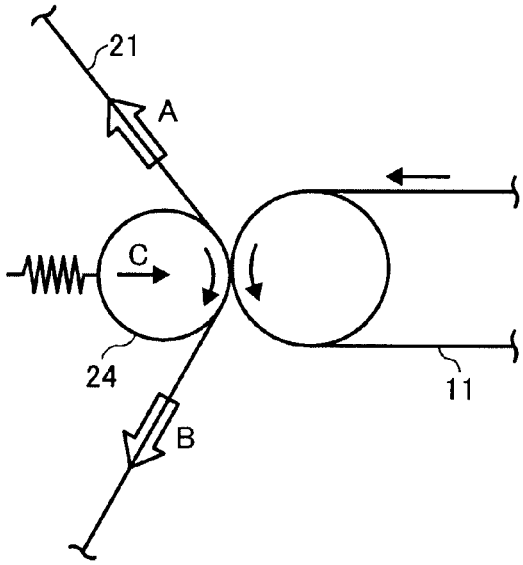
FIG. 1 BACKGROUND ART
FIG. 1 is an enlarged view illustrating a related art transfer-fixing belt in the vicinity of a secondary transfer nip.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on," "directly connected to" or "directly coupled to" another element or layer, then there are no intervening elements or layers present. Like numbers refer to like elements throughout figures. As used herein, the term "and/or" includes any and all combinations of one or more of the associated listed items.

Spatially relative terms, such as "beneath," "below," "lower," "above," "upper" and the like, may be used herein for ease of description to describe an element or an element's feature or relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, the term such as "below" can encompass both an orientation of above and below.

The device may be otherwise oriented at various angles (i.e. rotated 90 degrees or at other orientations), and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now explained below with reference to the accompanying drawings.

In the later described comparative example, exemplary embodiment, and alternative example, for the sake of simplicity of drawings and descriptions, the same reference numerals will be given to constituent elements such as parts and materials having the same functions, and the descriptions thereof will be omitted unless otherwise stated.

Typically, but not necessarily, paper is the medium from which is made a sheet on which an image is to be formed. Other printable media are available in sheets and their use here is included. For simplicity, this Detailed Description section refers to paper, sheets thereof, paper feeder, etc. It should be understood, however, that the sheets, etc., are not limited only to paper.

Figure 2:
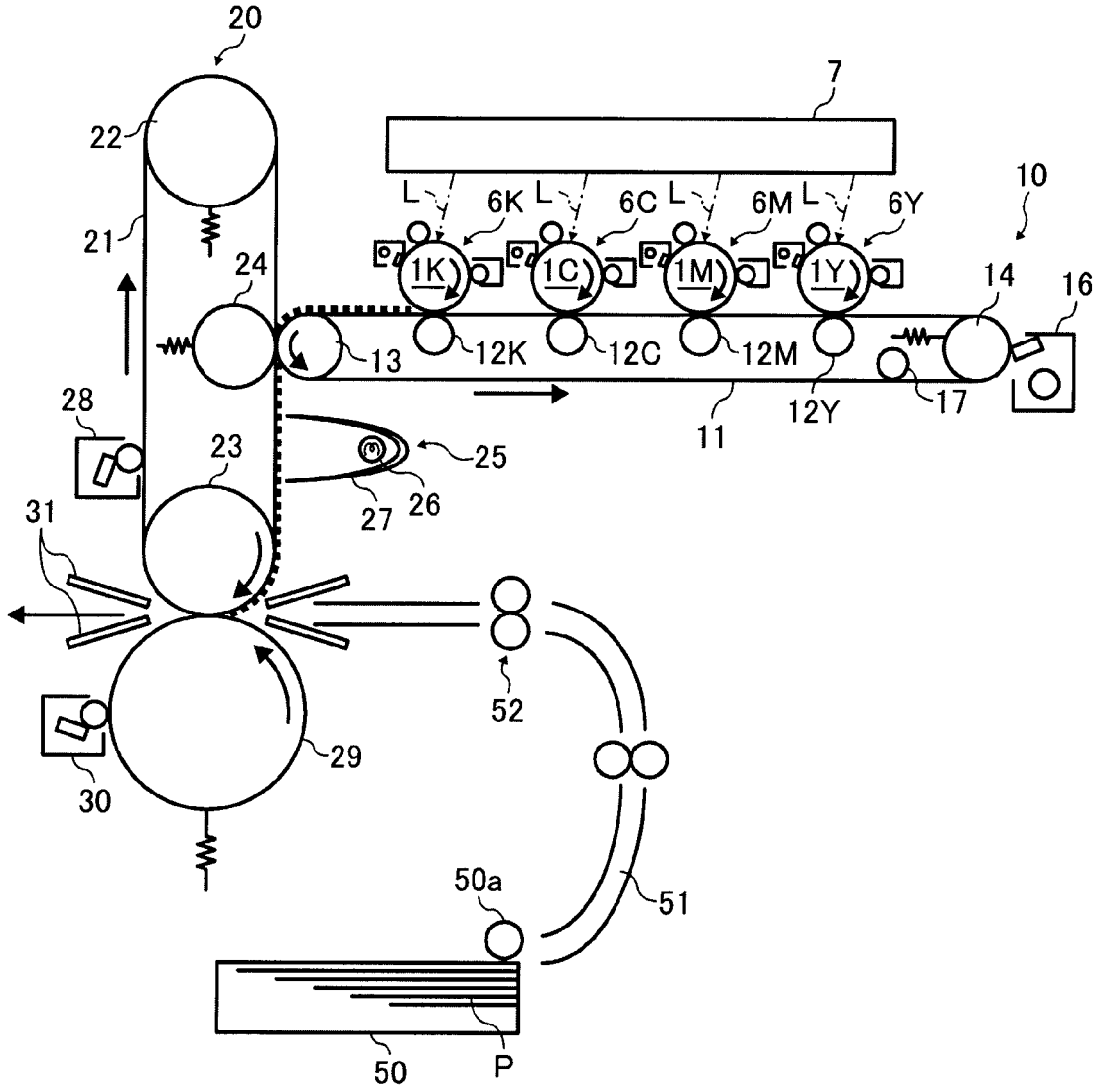
FIG. 2 is a schematic diagram illustrating an image forming apparatus, for example, a printer, according to exemplary embodiments of the present invention.

Referring now to the drawings, wherein like reference numerals designate identical or corresponding parts throughout the several views, particularly to FIG. 2, a structure of an image forming apparatus, for example, a printer using an electrophotographic method according to an exemplary embodiment of the present invention is described.

FIG. 2 is a schematic diagram illustrating an image forming apparatus serving as a printer according to an exemplary embodiment of the present invention.

The printer in one embodiment includes at least photosensitive drums 1Y, 1M, 1C and 1K serving as a drum-type latent image carrier, four process units 6Y, 6M, 6C and 6K, an optical writing unit 7 serving as a latent image forming mechanism, an intermediate transfer unit 10 and so forth.

The letter symbols Y, M, C and K herein denote colors of yellow, magenta, cyan and black, respectively.

The process units 6Y, 6M, 6C and 6K carry out an image forming process for forming toner images of different colors: yellow (Y), magenta (M), cyan (C) and black (K). The process units 6Y, 6M, 6C and 6K may be replaced when the process units 6Y, 6M, 6C and 6K reach end of life.

The structure of the process units 6Y, 6M, 6C and 6K are similar, if not the same, except that toners of respective colors as an image forming material are different. Thus, a description will be given of the process unit 6Y forming an yellow image (e.g., Y-image) as a representative example.

Figure 3:
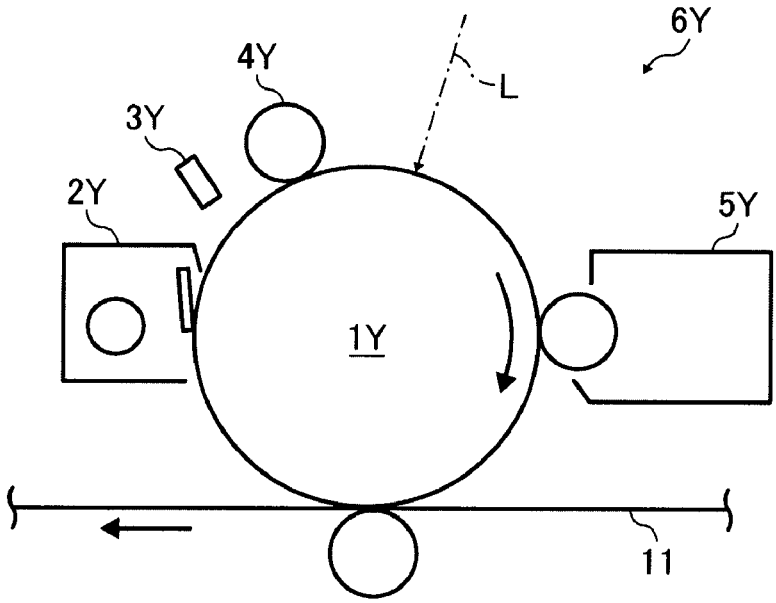
FIG. 3 is an enlarged view illustrating one example of a process unit of the image forming apparatus of FIG. 2.

As shown in FIG. 3, the process unit 6Y for forming an yellow toner image at least includes the drum-type photosensitive drum 1Y serving as a latent image carrier, a drum cleaning unit 2Y, a discharging unit 3Y, a charging unit 4Y, a developing unit 5Y and so forth.

The photosensitive drum 1Y is a drum-shape metal tube covered with a photosensitive layer and is rotatively driven in a clockwise direction by a drive mechanism (not shown).

The charging unit 4Y includes a charging roller to which a charging bias is applied by a charging bias power source (not shown) and rotatively driven while coming into contact with or coming closer to the photosensitive drum 1Y. Accordingly, the surface of the photosensitive drum 1Y is evenly charged by the electric discharge of the charging roller.

Alternatively, instead of using the charging roller, a charging brush may be utilized to charge the photosensitive drum 1Y. The photosensitive drum 1Y may be evenly charged by means of corona charging.

The surface of the photosensitive drum 1Y is evenly charged. Subsequently, the surface thereof is exposed and scanned by a laser beam L emitted from the optical writing unit 7. Accordingly, the photosensitive drum 1Y carries an electrostatic latent image of yellow.

The electrostatic latent image of yellow is developed by the developing unit 5Y using a yellow toner so that a yellow toner image is formed. Subsequently, the yellow toner image is primarily transferred to the intermediate transfer belt 11.

The drum cleaning unit 2Y removes toner remained on the photosensitive drum 1Y after the primary transfer process.

The discharging unit 3Y removes a residual charge from the photosensitive drum 1Y after cleaning. Accordingly, the surface of the photosensitive drum 1Y is initialized and prepared for a subsequent image forming operation.

Similar to the process unit 6Y, in the process units 6M, 6C and 6K of other colors, toner images of magenta, cyan and black are formed on the photosensitive drums 1M, 1C and 1K, respectively.

As shown in FIG. 2, the optical writing unit 7 is disposed above the process units 6Y, 6M, 6C and 6K.

The optical writing unit 7 serving as a latent image forming mechanism optically scans the photosensitive drums 1Y through 1K of respective process units 6Y through 6K with a laser beam L based on an image information transmitted from a personal computer (not shown), for example.

According to the optical scanning, electrostatic latent images of yellow, magenta, cyan and black are formed on the photosensitive drums 1Y, 1M, 1C and 1K, respectively.

The optical writing unit 7 irradiates the photosensitive drums 1Y through 1K with the laser beam L emitted from a light source by way of a plurality of optical lenses and mirrors while a polygon mirror which is rotatively driven by a motor (not shown) scans the laser beam L in a main scanning direction.

Instead of the optical writing unit 7 of the exemplary embodiment, a structure using an LED array which emits an LED light may be used.

As shown in FIG. 2, a sheet feed cassette 50 is provided below the intermediate transfer belt 11. The sheet feed cassette 50 stores a sheet bundle consisting of a plurality of recording sheets P serving as a recording medium.

A sheet feed roller 50*a* is pressed against the top sheet of the recording sheet P.

When the sheet feed roller 50*a* is rotatively driven, the top sheet of the recording sheets P is sent to a sheet feed path 51.

Subsequently, the recording sheet P is transported to a space between the registration rollers 52 disposed at the end of the sheet feed path 51.

A pair of registration rollers 52 is each rotatively driven so as to nip the recording sheet P. As soon as the registration rollers 52 nip the recording sheet P, the rotation thereof is temporarily stopped.

As will be later described, the rotation is resumed in synchronization with a transfer timing of a toner image onto the recording sheet P at a transfer-fixing nip.

As shown in FIG. 2, beneath the process units 6Y, 6M, 6C and 6K, the intermediate transfer unit 10 is disposed. In the intermediate transfer unit 10, the intermediate transfer belt 11 serving as an intermediate transfer member and an image carrier is stretchedly arranged and endlessly moved.

In addition to the intermediate transfer belt 11, the intermediate transfer unit 10 further includes a belt cleaning unit 16, a belt cooling unit 17, four primary transfer bias rollers 12Y, 12M, 12C and 12K, a secondary transfer-drive roller 13 serving also as a drive roller, a tension roller 14 and so forth.

The rear surface or an inner surface of the intermediate transfer belt 11 is supported and stretchedly arranged at a predetermined tension by spanning rollers.

The intermediate transfer belt 11 is endlessly moved by the secondary transfer-drive roller 13 rotatively driven in a counterclockwise direction shown in FIG. 2 by a drive mechanism (not shown).

The intermediate transfer belt 11 endlessly moving is nipped by the four primary transfer bias rollers 12Y, 12M, 12C and 12K, and the photosensitive drums 1Y, 1M, 1C and 1K. Accordingly, a primary transfer nip is formed at places where the photosensitive drums 1Y, 1M, 1C and 1K abut the surface of the intermediate transfer belt 11.

The primary transfer bias rollers 12Y, 12M, 12C and 12K apply a transfer bias of reverse polarity (i.e., positive polarity) relative to a charging polarity of toner. However, the primary transfer bias rollers 12Y, 12M, 12C and 12K may be of a charger-type allowing a discharge from an electrode.

When the intermediate transfer belt 11 endlessly travels passing the primary transfer nips of each color, the toner images of yellow, magenta, cyan and black on the photosensitive drums 1Y, 1M, 1C and 1K are primarily transferred and sequentially overlapped one on another on the intermediate transfer belt 11.

Accordingly, the toner images of four colors are overlapped one on another forming a four-color toner image on the intermediate transfer belt 11.

As shown in FIG. 2, toward the left of the intermediate transfer unit 10, a transfer-fixing unit 20 which causes a transfer-fixing belt 21 to endlessly move is provided.

The transfer-fixing belt 21 comes into contact with the intermediate transfer belt 11 at a position where the intermediate transfer belt 11 is laid on the secondary transfer-drive roller 13. Accordingly, a secondary transfer nip is formed therebetween.

After passing the secondary transfer nip, an inner loop of the intermediate transfer belt 11 comes into contact with the belt cooling unit 17 at a position before the intermediate transfer belt 11 advances to the primary transfer nip of yellow to which the primary transfer process is performed first among yellow, magenta, cyan and black.

The belt cooling unit 17 is equipped with a cooling member, for example, a heat pipe formed of a material having a high heat conductivity.

When the belt cooling unit 17 causes the cooling member contacting the rear surface of the intermediate transfer belt 11 to rotate, the intermediate transfer belt 11 is cooled from the rear surface thereof.

Cooling of the intermediate transfer belt may be enhanced when a fan (not shown) or the like blows air to the cooling member which in turn cools the belt.

A secondary transfer bias supply mechanism (not shown) applies to the secondary transfer-drive roller 13 of the intermediate transfer unit 10 the secondary transfer bias having the same polarity as the charging polarity of the toner (i.e., a direct-current bias of −0.5 to −2 kV or a superimposed direct-current bias on an alternating current).

As will be later described, a pressure roller 24 of the transfer-fixing unit 20 is connected to ground. Accordingly, a secondary transfer electric field to electrostatically transport toner from the intermediate transfer belt 11 to the transfer-fixing belt 21 is formed in the secondary transfer nip formed between the secondary transfer-drive roller 13 and the pressure roller 24.

The four-color toner image advances to the secondary transfer nip in conjunction with traveling of the intermediate transfer belt 11.

Subsequently, the secondary transfer electric field and the nip pressure act on the four-color toner image so that the four-color toner image is secondarily transferred on the front surface of the transfer-fixing belt 21 at once.

The transfer-fixing unit 20 at least includes a tension roller 22, a transfer-fixing/drive roller 23 and the pressure roller 24. The endless transfer-fixing belt 21 is stretchedly arranged between these rollers causing the endless transfer-fixing belt 21 to endlessly travel in a clockwise direction.

The transfer-fixing unit 20 further includes a heating unit 25, a belt cleaning unit 28, a fixing pressure roller 29 and so forth.

The transfer-fixing belt 21 may include an endless-belt base formed of metal (i.e., iron), a heat resistant resin (i.e., polyimide), or any other suitable material.

On the surface the belt base, an elastic layer formed of an elastic material (i.e., silicone rubber) and a release enhancement layer formed of a material having a low friction coefficient (i.e., a fluoro-rubber) are subsequentially laminated.

The belt base preferably has a thickness of less than or equal to 0.1 mm in order to shorten a warm-up time in which a heat source reaches a predetermined temperature and enhancement of an endless mobility.

The elastic layer preferably has a thickness of no more than 0.1 mm in order to demonstrate a universal hardness of the surface layer. Furthermore, when taking the warm-up time into account, the thickness of no more than 0.5 mm is preferred.

The release enhancement layer preferably has a thickness of no more than 30 μm in order to demonstrate the universal hardness of the surface layer.

The transfer-fixing/drive roller 23 at least includes a non-hollow roller core formed of a metal, for example, iron. The non-hollow roller core is covered with an elastic layer made of an elastic material, for example, a rubber, having a thickness of approximately 1 to 3 mm.

The transfer-fixing/drive roller 23 is rotatively driven in a clockwise direction by a drive mechanism (not shown). Accordingly, the transfer-fixing belt 21 is endlessly moved in a clockwise direction.

A later-described fixing pressure roller 29 exerts a relatively heavy weight on the transfer-fixing/drive roller 23. Therefore, a material having a surface hardness of no less than 80 on the Asker C scale is preferable for the transfer-fixing/drive roller 23.

In order to shorten the warm-up time by enhancing the thermal insulation performance relative to the transfer-fixing belt 21, a rigid heat-insulating layer formed of a porous ceramic or the like may be provided between a roller core and the elastic layer.

The tension roller 22 provides a tension to the transfer-fixing belt 21 when a tension spring biases the tension roller 22.

A pressure spring biases the pressure roller 24 serving as a pressure member against the intermediate transfer unit 10 so that the transfer-fixing belt 21 is pressed against the intermediate transfer belt 11 at a place where the intermediate transfer belt 11 is laid on the secondary transfer-drive roller 13.

Consequently, the front surface of the transfer-fixing belt 21 is pressed against the front surface of the intermediate transfer belt 11 so that the secondary transfer nip is formed therebetween.

The pressure roller 24 at least includes a roller core formed of a metal, for example, iron. On the surface of the metal (i.e., iron) roller core, a heat insulating layer made of, for example, a porous ceramic having a high hardness, an elastic layer made of an elastic material such as a silicone rubber, and a release enhancement layer made of a fluoro-rubber or the like are sequentially laminated.

A pressure spring biases the fixing-pressure roller 29 against the transfer-fixing belt 21 at a position where the transfer-fixing belt 21 is laid on the transfer-fixing/drive roller 23.

Accordingly, the transfer-fixing belt 21 and fixing-pressure roller 29 come into contact with each other so that the transfer-fixing nip is formed therebetween.

The four-color toner image is secondarily transferred from the intermediate transfer belt 11 to the transfer-fixing belt 21 at the secondary fixing nip. Subsequently, the secondarily transferred four-color toner image is transported to the transfer-fixing nip in conjunction with the endless movement of the transfer-fixing belt 21.

At this time, the four-color toner image passes the side of the belt heating unit 25 facing the front surface of the transfer-fixing belt 21 through a given gap.

The belt heating unit 25 at least includes a heater 26 and a reflective plate 27 which reflects a thermal light from the heater 26 onto the transfer-fixing belt 21. The heater 26 may be a halogen heater, for example.

The radiant energy emitted from the heater 26 may directly be applied to the transfer-fixing belt 21. The radiant energy emitted from the heater 26 may be reflected on the reflective plate 27 so that the radiant energy is concentrated on the belt. Accordingly, the four-color toner image on the belt is adequately heated.

A thermistor (not shown) detects a surface temperature of the transfer-fixing belt 21. Based on the detection result, the "on/off" of the power source of the heater 26 may be controlled. Accordingly, the surface temperature of the transfer-fixing belt 21 is prevented from rising beyond a predetermined temperature.

The four-color toner image adequately heated by the heating unit 25 serving as a heating mechanism advances to the transfer-fixing nip in conjunction with the endless movement of the transfer-fixing belt 21.

When the four-color toner image comes into contact with the recording sheet P sent from a pair of the above-described registration rollers 52 in the transfer-fixing nip, the four-color toner image is thirdly transferred onto the recording sheet P by the effect of self viscosity and the nip pressure.

In the printer according to the exemplary embodiment, the four-color toner image is pressed on the transfer-fixing belt 21 separately from the recording sheet P prior to fixing the four-color toner image on the recording sheet P.

Accordingly, a heat loss is reduced when compared with a configuration in which the recording sheet P and the four-color toner image are pressed together while the four-color image is fixed on the recording sheet P.

According to experiments performed by the present inventors, this configuration achieved an adequate gloss and a fixability when the temperature of the transfer belt 21 was increased to a relatively low temperature of 110 to 120 deg. C.

When a conductive fluoro-resin material in which a conductive material, for example, carbon, is dispersed is used for the release enhancement layer, the elastic layer and the roller core of the transfer-fixing belt 21, a secondary transfer electric field is formed between the release enhancement layer of the intermediate transfer belt 11 and the release enhancement layer of the transfer-fixing belt 21.

Accordingly, the secondary transfer bias is further reduced to a low voltage. Furthermore, toner scattering at the secondary transfer may be reduced.

A small amount of toner which has not been secondarily transferred to the transfer-fixing belt 21 is adhered to the surface of the intermediate transfer belt 11 after passing the secondary transfer nip.

The belt cleaning unit 16 abutting the front surface of the intermediate transfer belt 11 at a position where the intermediate transfer belt 11 is laid on the tension roller 14 removes the toner residue from the intermediate transfer belt 11.

A small amount of toner which has not been thirdly transferred to the recording sheet P is adhered on the surface of the transfer-fixing belt 21 after passing the transfer fixing nip.

The belt cleaning unit 28 abutting the transfer-fixing belt 21 at a spanned position between the tension roller 22 and the transfer-fixing/driving roller 23 removes the toner residue from the surface of the transfer-fixing belt 21.

Paper dust traveled from the recording sheet P may be adhered on the surface of the fixing-pressure roller 29 after passing the transfer-fixing nip.

The roller cleaning unit 30 abutting the fixing-pressure roller 29 removes the paper dust from the surface of the fixing-pressure roller 29.

The recording sheet P ejected from the transfer-fixing nip is guided by guide plates 31 and is ejected out of the printer.

In the above-described secondary transfer nip, the transferability of the four-color toner image depends largely on a contact pressure between the intermediate transfer belt 11 and the transfer-fixing belt 21.

The contact pressure in the transfer nip is hereinafter referred to as transfer nip pressure.

Figure 4:
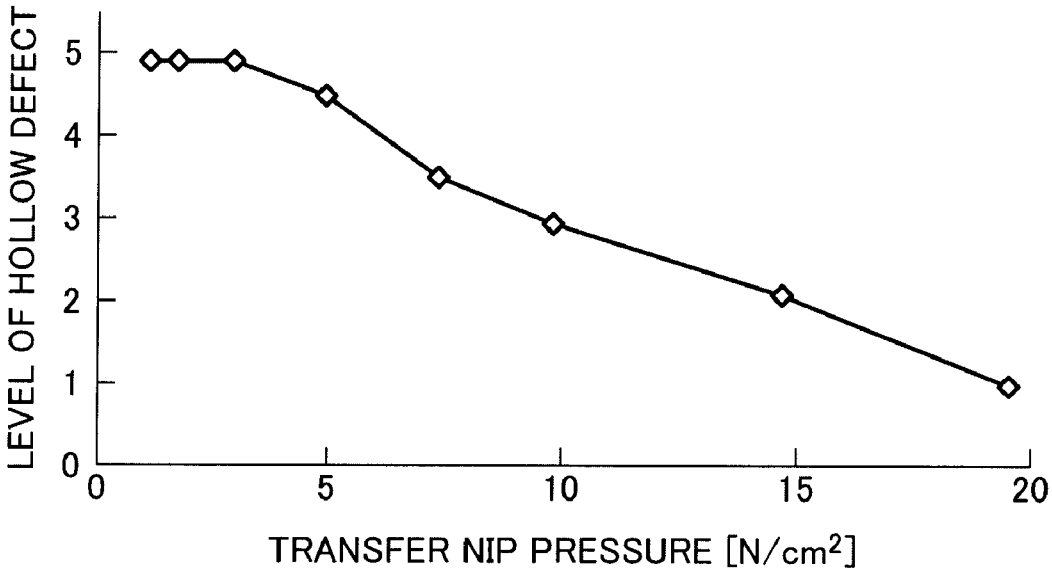
FIG. 4 is a graphical representation of a relationship between a transfer nip pressure and a level of hollow defect according to exemplary embodiments.

Referring now to FIG. 4, there is provided a graphical representation of a relationship between a transfer nip pressure and a level of hollow defect in a four-color toner image according to the experiments performed by the present inventors.

In FIG. 4, Level 5 of the hollow defect indicates that no hollow defect was detected in a test image when the test image was printed out and examined by a magnifier with the magnification power of 25×.

Level 4 of the hollow defect indicates that no hollow defect was detected in the test image when visually examined with the naked eye while a slight hollow defect was detected when the test image was examined by a magnifier with the magnification power of 25×.

Level 3 of the hollow defect indicates that a hollow defect was detected when the test image was closely examined with the naked eye.

Level 2 of the hollow defect indicates that a hollow defect was detected when the test image was examined with the naked eye.

Level 1 of the hollow defect indicates that a hollow defect was easily detected when the test image was examined with the naked eye, and image degradation was significant.

Acceptable levels of the hollow defect are levels 3 through 5. The levels 1 and 2 are considered as "not acceptable."

Conditions for Experiments:

The following conditions were used for the experiments.

The base material for the intermediate transfer belt 11: Polyimide resin

Thickness of the belt: 80 μm

The transfer-fixing belt 21 includes a polyimide base on which an elastic layer of silicone rubber (Si-rubber) having a thickness of 300 μm and a release enhancement layer of PTFE (polytetrafluoroethylene) having a thickness of 10 μm are laminated.

Toner: Pulverized toner

As shown in FIG. 4, when the transfer nip pressure increased, a hollow defect was likely to be generated. In order to achieve an acceptable level of the hollow defect, that is, Level 3 and above, the transfer nip pressure needed to be no more than 10 $N/cm^2$.

Furthermore, when the transfer nip pressure was reduced to 5 $N/cm^2$ or less, the level in which no hollow defect was detected with the naked eye was achieved. In other words, Level 4 of the hollow defect and above was achieved.

The transfer nip pressure is preferably set to no more than 5 $N/cm^2$ at the secondary transfer nip.

However, when the tension of the transfer-fixing belt 21 serving as a drag force relative to the pressure spring which biases the pressure roller 24 is loosened for some reason, the spring bias of the pressure spring relative to the pressure roller 24 is enhanced.

Consequently, the transfer nip pressure increases at the secondary transfer-fixing nip.

When the front end of the recording sheet P is nipped by the transfer-fixing nip, a stress relative to the transfer-fixing/drive roller 23 temporarily, but suddenly increases. Consequently, the speed of the transfer-fixing belt 21 drops for a second.

In such a situation where the speed fluctuates, when the transfer-fixing belt 21 is stretchedly arranged in a manner as shown in FIG. 1, the tension of the transfer-fixing belt 21 stretchedly arranged between the tension roller 22 and the pressure roller 24 temporarily increases while the tension of the transfer-fixing belt 21 between the pressure roller 24 and the transfer-fixing drive roller 23 temporarily decreases.

When the resultant force of the tensions is further reduced, the spring bias of the pressure spring relative to the pressure roller 24 is enhanced, causing the secondary transfer nip pressure to increase.

Furthermore, when the rear end of the recording sheet P is ejected from the transfer-fixing nip, the stress relative to the transfer-fixing/drive roller 23 temporarily drops, and the speed of the transfer-fixing belt 21 suddenly increases.

In such a situation where the speed fluctuates, when the transfer-fixing belt 21 is stretchedly arranged in a manner as shown in FIG. 1, the tension of the transfer-fixing belt 21 stretchedly arranged between the tension roller 22 and the pressure roller 24 temporarily decreases while the tension of the transfer-fixing belt 21 stretchedly arranged between the pressure roller 24 and the transfer-fixing/drive roller 23 temporarily increases.

When the resultant force of the tensions is further reduced, the spring bias of the pressure spring relative to the pressure roller 24 is enhanced, causing the secondary transfer nip pressure to increase.

According to the experiments performed by the present inventors, when a relatively thick paper having a thickness of, for example, 100 $g/m^2$ or more, was used as a recording sheet P, there was a case where the fluctuation of a tension $T_1$ and a tension $T_2$ was 100% at a maximum which was twice the tension.

Figure 5:
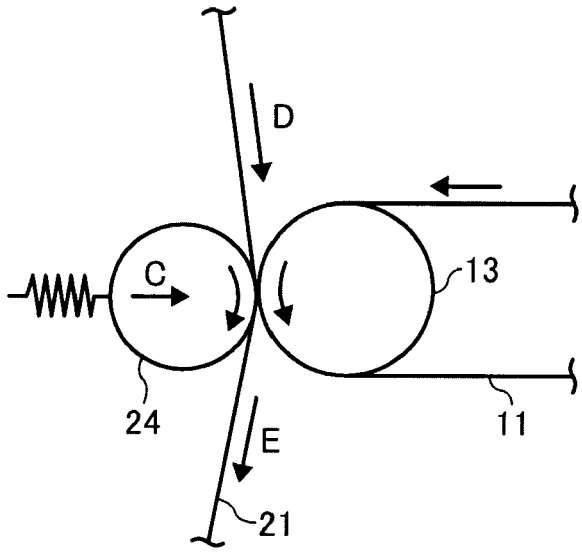
FIG. 5 is an enlarged view illustrating a secondary transfer nip and a surrounding structure thereof in the image forming apparatus according to exemplary embodiments.

As shown in FIG. 5, in the printer according to one exemplary embodiment, the transfer-fixing belt 21 is stretchedly arranged such that the transfer belt 21 travels, in the proximity of the secondary transfer nip, in directions (shown by arrows D and E) substantially perpendicular to a pressure direction shown by an arrow C of the pressure roller 24.

According to this configuration, even if the tension of the transfer-fixing belt 21 fluctuates in the proximity of the secondary transfer nip, the fluctuation of the tension acts on the directions D and E which are the spanning direction of the transfer-fixing belt 21 in the proximity of the secondary transfer nip.

Therefore, the fluctuation of the tension hardly acts on the force in the pressure direction (arrow C direction) relative to the pressure roller 24.

In other words, even if the tension of the transfer-fixing belt 21 fluctuates, the secondary transfer nip pressure hardly fluctuates.

Therefore, generation of a hollow defect in an image caused by the fluctuation of the transfer-fixing belt 21 is suppressed.

A description will be provided of a printer according to one exemplary embodiment. Unless otherwise specified, the configuration of the printer according to the exemplary embodiment is similar to, if not the same as the printer of the above-described exemplary embodiment.

The belt spanned portion linked to the secondary transfer nip further upstream of the secondary transfer nip and the belt spanned portion linked to the secondary transfer nip downstream of the secondary transfer nip are each moved in the direction perpendicular to the pressure direction (arrow C direction) of the pressure roller 24.

Accordingly, the fluctuation of the tension of the transfer-fixing belt 21 does not act on the pressure direction. Therefore, the fluctuation of the secondary transfer nip pressure due to the fluctuation of the tension of the transfer-fixing belt 21 is reduced, if not prevented.

However, Level 3 of the hollow defect or above may be achieved when the amount of fluctuation of the tension of the transfer-fixing belt acting on the pressure direction is insignificant.

Figure 6:
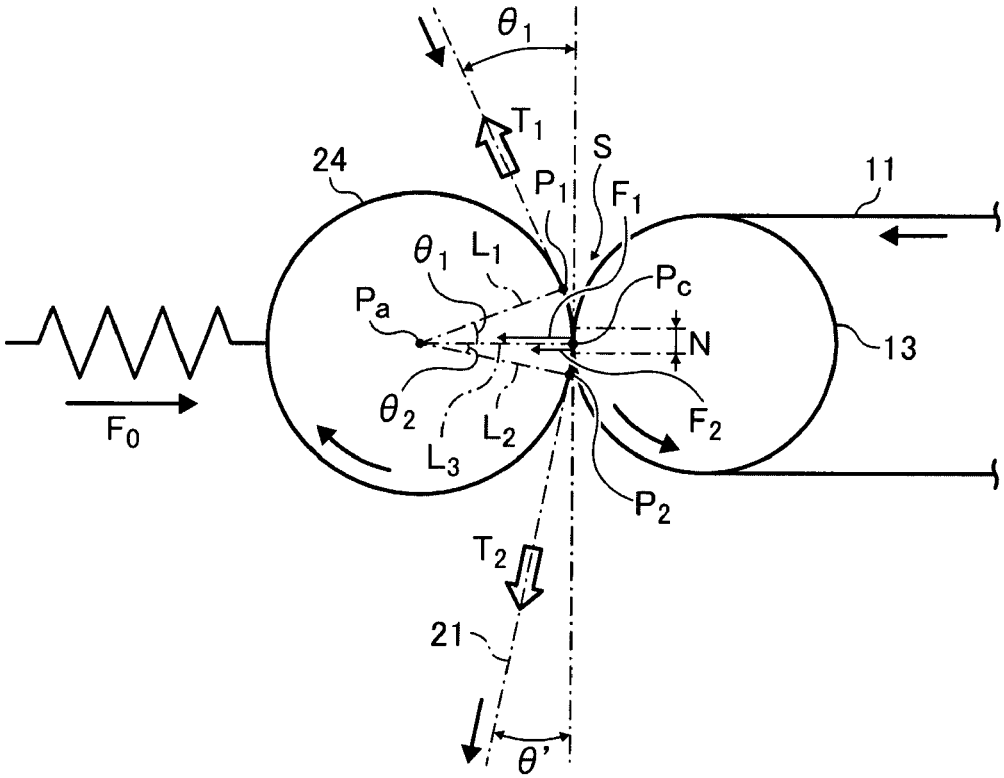
FIG. 6 is an enlarged view illustrating the secondary transfer nip and the surrounding structure thereof in the image forming apparatus according to exemplary embodiments.

Referring now to FIG. 6, there is provided an enlarged view illustrating the secondary transfer nip and a surrounding structure thereof in the printer according to one exemplary embodiment.

In FIG. 6, a dot Pc refers to a center point of the secondary transfer nip N where the transfer-fixing belt 21 and the intermediate transfer belt 11 come into contact with each other in the belt traveling direction.

A dot $P_1$ refers to a start point of belt winding of the transfer-fixing belt 21 which endlessly travels relative to the curved surface of the pressure roller 24.

A dash-dotted line $L_1$ refers to a first virtual line segment extending from the winding start point $P_1$ to a center point Pa of a virtual circle having the same curvature as the curvature of the pressure roller 24.

In the exemplary embodiment, the virtual circle corresponds to a peripheral surface of the pressure roller 24.

$\theta_1$ refers to an angle between the first virtual line segment $L_1$ and a third virtual line segment $L_3$ extending from the center point Pc of the secondary transfer nip to the center Pa of the virtual circle.

A dot $P_2$ refers to a finish point of a belt winding of the transfer-fixing belt 21 relative to the pressure roller 24.

$\theta_2$ refers to an angle between a second virtual line segment $L_2$ extending from the winding finish point $P_2$ to the center Pa of the virtual circle, and the third virtual line segment $L_3$.

$T_1$ refers to a tension in the proximity of the winding start point $P_1$ of the transfer-fixing belt 21 in the resting state.

$T_2$ refers to a tension in the proximity of the winding finish point $P_2$ of the transfer-fixing belt 21 in the resting state.

$F_0$ refers to a pressure force of the pressure spring which biases the pressure roller 24.

In FIG. 6, when S [$cm_2$] is an area of the secondary transfer nip, the secondary nip pressure per unit area [$N/cm_2$] is defined as follows:

$$\text{Secondary transfer nip pressure}=(F-(T_1 \sin\theta_1+T_2 \sin\theta_2))/S \quad (1).$$

At the secondary transfer, it is necessary that the secondary transfer-drive roller 13 not be separated from the intermediate transfer belt 11. Therefore, Equation 1 is modified as follows:

$$0<(F-(T_1 \sin\theta_1+T_2 \sin\theta_2))/S \quad (2).$$

In order to secure the hollow defect within an acceptable level, that is, Level 3 or above, the following relationship is satisfied:

$$0<(F-(T_1 \sin\theta_1+T_2 \sin\theta_2))/S\leqq 10\ N/cm^2 \quad (3).$$

Furthermore, in order to suppress the hollow defect to the level at which the hollow defect cannot visually be detected with the naked eye, the following relationship is satisfied:

$$0<(F-(T_1 \sin\theta_1+T_2 \sin\theta_2))/S\leqq 5\ N/cm^2 \quad (4).$$

When the recording sheet P advances to the transfer-fixing nip or the recording sheet P is ejected from the transfer-fixing nip causing the tension of the transfer-fixing belt 21 to fluctuate, it is necessary to satisfy the equations 3 and 4.

In order to satisfy the equations 3 and 4, both angles $\theta_1$ and $\theta_2$ are set to 0 degree so that the transfer-fixing belt 21 travels in a direction perpendicular to the pressure direction of the pressure spring in the proximity of the secondary transfer nip.

Furthermore, even if when the tension is set relatively low, the acceptable level of hollow defect is still achieved even if the angles $\theta_1$ and $\theta_2$ are not 0 degrees, and the fluctuation of the tension causes the pressure force to fluctuate.

Referring back to FIG. 4, according to the experiments, even if the tension fluctuated, Equation 3 was continued to be satisfied when the secondary transfer nip pressure at the resting state was set at 7.5 $N/cm^2$, which approximately corresponds to Level 2.5 of the hollow defect, instead of setting it at 10 $N/cm^2$, which is closed to Level 3 of the hollow defect.

The angles $\theta_1$ and $\theta_2$ were set to a relatively small angle so that the fluctuation of the secondary transfer nip pressure due to the tension fluctuation was no more than 2.5 $N/cm^2$.

Accordingly, even if the tension fluctuated, the secondary transfer nip pressure was secured at 10 $N/cm^2$ or less.

A part of the tension of the transfer-fixing belt 21 acts as a drag force against the pressure force of the pressure spring which biases the pressure roller 24 into the intermediate transfer belt 11.

The drag force is a resultant force of the drag force $F_1$ and the drag force $F_2$ as shown in FIG. 6. The drag force $F_1$ arises from the tension $T_1$ further upstream of the secondary transfer nip of the transfer-fixing belt 21. The drag force $F_2$ arises from the tension $T_2$ further downstream of the secondary transfer nip.

Even if the resultant force of the tension $T_1$ and tension $T_2$ of the transfer-fixing belt 21 is reduced due to the fluctuation of the belt speed, the level of the hollow defect is secured within the acceptable level, that is, Level 3 when the resultant force of the drag force $F_1$ and $F_2$ is no less than 2.5 $N/cm^2$.

When S [$cm_2$] is an area of the secondary transfer nip, the drag force $F_1$ is represented as follows:

$$\text{Drag force } F_1[N/cm_2]=T_1 \sin\theta_1/S \quad (5).$$

The drag force $F_2$ is represented as below.

$$\text{Drag force } F_2[N/cm_2]=T_1 \sin\theta_1/S \quad (6).$$

Therefore, when the angles $\theta_1$ and $\theta_2$ are configured to satisfy the following relationship, the level of the hollow defect is secured within the acceptable level, that is, Level 3.

$$T_1 \sin\theta_1+T_2 \sin\theta_2<2.5\times S \quad (7).$$

Therefore, in the printer according to the exemplary embodiment, the angles $\theta_1$ and $\theta_2$ are configured to satisfy the equation (7).

When the tension of the transfer-fixing belt 21 is significantly weak, the performance of the transfer-fixing belt 21 may become unstable or the driving force may not be accurately transmitted.

On the contrary, when the tension of the transfer-fixing belt 21 is significantly strenuous, the transfer-fixing belt 21 may be stretched, and/or may be strenuously laid around the roller so that a plastic deformation may occur.

For this reason, the tension is normally configured to be approximately 10 to 50 N.

The width of the secondary transfer nip is normally configured to be in a range between 1 and 10 mm.

However, in such a printer simultaneously performing transfer and fixing processing, it is advantageous to configure the nip width to be relatively narrow so that it becomes possible to suppress the amount of the heat conduction from the transfer-fixing belt 21 to the recording sheet P.

In general, the length of the secondary transfer nip in the direction perpendicular to the belt traveling direction is configured to be approximately 300 to 350 mm in the structure in which the maximum vertical length of a passing sheet corresponds to A3 size paper sheet.

Furthermore, in general, the length of the secondary transfer nip in the direction perpendicular to the belt traveling direction is configured to be approximately 220 to 250 mm in the structure in which the maximum vertical length of a passing sheet corresponds to A4 size paper sheet.

In a first experiment, the present inventors used a printer having a structure similar to, if not the same as the printer shown in FIG. 2.

The printer used in the experiment is herein after referred to as a test printer. The transfer-fixing belt 21 in the resting state was stretchedly arranged at a tension of 30N.

As described above, when the recording sheet P advances to the transfer-fixing nip, and/or the recording sheet P is ejected from the transfer-fixing nip, the tension may fluctuate twice as much the tension in the resting state.

In other words, it is possible that the tension may fluctuate by ±30N relative to the tension of 30N in the resting state.

In the experiment, the nip width which was a length in the belt traveling direction in the secondary transfer nip of the test printer was set to 0.1 cm.

The nip length in the direction perpendicular to the belt traveling direction was set to 32 cm which may accommodate A3 size paper.

Therefore, the area S of the secondary transfer nip was: $0.1\times32=3.2\ cm^2$.

The secondary transfer nip pressure was set to 7.5 $N/cm^2$.

According to the test printer having the above-described structure, in order to maintain the level of the hollow defect within the acceptable level, that is, Level 3 the following relationship is satisfied:

$$30 \sin \theta_1+30 \sin \theta_2<2.5\times3.2\ cm^2 \quad (8).$$

When the above equation is expanded, the following equation is obtained.

$$\theta_1+\theta_2<15.4 \text{ degrees} \quad (9).$$

An experiment was performed when the sum of the angle $\theta_1$ and the angle $\theta_2$ in the test printer was configured to be no more than 15.4 degrees, and a test image was continuously printed.

According to the experiment, even after more than 1000 prints were made, the level of the hollow defect was Level 3 or above in all the prints.

In a second experiment, an experiment was performed when the transfer-fixing belt 21 was stretchedly arranged at a tension of 50 N in the resting state.

As described above, when the recording sheet P advances to the transfer-fixing nip, and/or the recording sheet P is ejected from the transfer-fixing nip, the tension may fluctuate twice as much the tension in the resting state.

In other words, it is possible that the tension may fluctuate by ±50 N relative to the tension of 50N in the resting state.

In the second experiment, the nip pressure, the nip width and the nip area of the secondary transfer nip were the same as that of the experiment 1.

According to the test printer having the above-described structure, in order to maintain the level of the hollow defect within the acceptable level, that is, Level 3, the following relationship is satisfied:

$$50 \sin \theta_1+50 \sin \theta_2<2.5\times3.2\ cm^2 \quad (10).$$

When the above equation is expanded, the following equation is obtained.

$$\theta_1+\theta_2<6.6 \text{ degrees} \quad (11).$$

An experiment was performed when the sum of the angle $\theta_1$ and the angle $\theta_2$ in the test printer was configured to be no more than 6.6 degrees, and a test image was continuously printed.

According to the experiment, even after more than 1000 prints were made, the level of the hollow defect was Level 3 or above in all the prints.

As described above, when both angles $\theta_1$ and $\theta_2$ are set to 0 degrees, it is possible to reduce, if not prevent, the hollow defect caused by the fluctuation of the tension of the transfer-fixing belt 21.

In a third experiment, the sum of the angles $\theta_1$ and $\theta_2$ was set to 0 degrees in the test printer. The following conditions were used for the experiments.

Conditions for Experiments:

Diameter of the pressure roller 24: 40 mm

Diameter of the secondary transfer-drive roller 13: 30 mm

Thickness of the transfer-fixing belt 21: 0.4 mm

Angle $\theta_1$: 2.5 degrees

Angle $\theta_2$: 2.5 degrees

Secondary transfer nip angle: 7 degrees

The secondary transfer nip angle is an angle between a line segment extending from the center of the roller 13 to a nip entrance point and a line segment extending from the center of the roller 13 to a nip exit point.

Tension ($T_1$ and $T_2$): 30 N

Pressure force by the pressure spring $F_0$: 40 N

Secondary transfer nip pressure in the resting state: 4.2 $N/cm^2$

When a continuous printing was performed in the condition described above, no hollow defect which can be visually detected with the naked eye was generated.

However, there were some irregularities in the test image. The cause was known that when the angles $\theta_1$ and $\theta_2$ were substantially small, the transfer-fixing belt 21 and the intermediate transfer belt 11 were forced to come into contact with each other in the vicinity of the secondary fixing nip due to slight waving or wrinkles of the belts.

Thus, it is desirable that the winding start point $P_1$ is positioned further upstream in the belt traveling direction than the entrance point of the secondary transfer nip.

Thereby, it is possible to reduce, if not prevent, belt waving or wrinkles in the vicinity of the nip entrance when the transfer-fixing belt 21 is laid on the pressure roller 24 in the vicinity of the secondary transfer nip and upstream of the secondary transfer nip before the transfer-fixing belt 21 advances to the secondary transfer nip.

Furthermore, it is desirable that the winding finish point $P_2$ is positioned further downstream in the belt traveling direction than the exit point of the secondary transfer nip.

Thereby, it is possible to reduce, if not prevent, belt waving or wrinkles in the vicinity of the nip exit when the transfer-fixing belt is laid on the pressure roller 24 by a predetermined amount after passing the secondary transfer nip.

Figure 7:
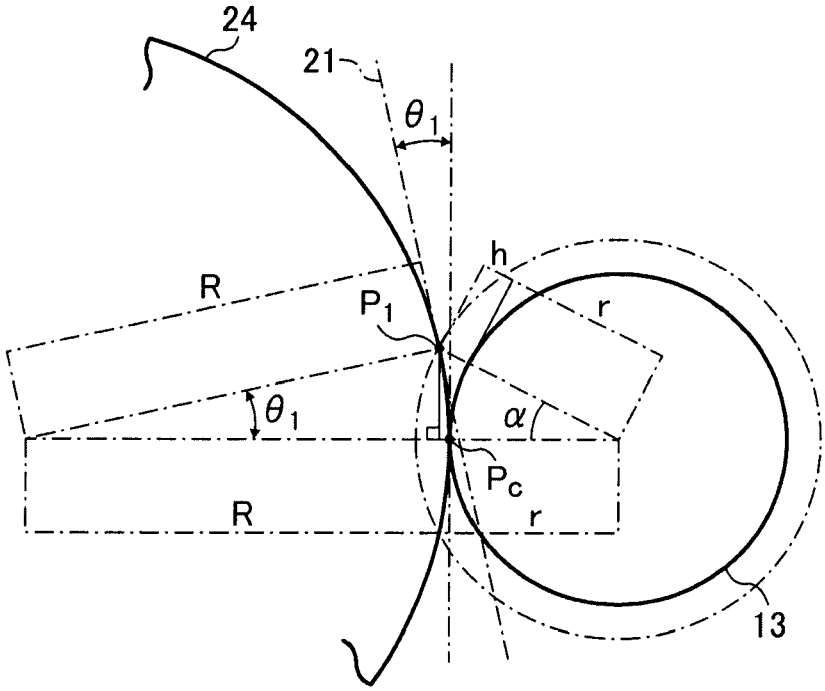
FIG. 7 is an enlarged view illustrating a minimum distance h from a belt winding start point $P_1$ to a surface of a secondary transfer-drive roller.

Referring now to FIG. 7, there is provided an enlarged view for explaining a minimum distance h from the winding start point $P_1$ of the transfer-fixing belt 21 relative to the pressure roller 24 to the surface of the secondary transfer-drive roller 13.

In FIG. 7, R represents a radius of the pressure roller 24. r represents a radius of the secondary transfer-drive roller 13. $\alpha$ represents an angle between a virtual line segment extending from the center of the secondary transfer nip Pc to the center of the secondary transfer-drive roller 13 and a virtual line segment extending from the center of the secondary transfer-drive roller 13 to the winding start point $P_1$.

As described above, it is desirable that the winding start point $P_1$ is positioned further upstream in the belt traveling direction of the transfer-fixing belt 21 than the secondary transfer nip entrance.

Furthermore, it is desirable that the winding finish point $P_2$ is positioned further downstream in the belt traveling direction of the transfer-fixing belt 21 than the secondary transfer nip exit.

However, even if the winding start point $P_1$ is positioned upstream of the nip entrance point, when the minimum distance between the winding start point $P_1$ and the secondary transfer-drive roller 13 is significantly short, irregularities in the image may not be effectively prevented.

In addition, even if the winding finish point $P_2$ is positioned further downstream than the nip entrance point, when the minimum distance between the winding finish point $P_2$ and the secondary transfer-drive roller 13 is significantly short, irregularities in the image may not be effectively prevented.

In light of the above, the present inventors performed an experiment in which the minimum distance h between the winding start point $P_1$ and the secondary transfer-drive roller 13 was varied, and test images were printed out to examine image irregularities in the test printer.

The transfer-fixing belt 21 used in the experiment included a base made of polyimide resin having a thickness between 50 to 150 μm on which an elastic layer of rubber having a thickness of 100 to 500 μm, and a release enhancement layer of PTFE (polytetrafluoroethylene) having a thickness of 3 to 15 μm were laminated.

The minimum distance between the winding finish point $P_2$ and the secondary transfer-drive roller 13 was set to the same value as the above-described minimum distance h.

The result of this experiment is shown in Table 1.

TABLE 1

| MINIMUM DISTANCE h (mm) | IMAGE IRREGULARITY |
|---|---|
| 0 | YES |
| 0.5 | YES |
| 1 | NO |
| 1.5 | NO |
| 2 | NO |
| 2.5 | NO |

As shown in TABLE 1, when both the minimum distances between the winding start point $P_1$ and the secondary transfer-drive roller 13, and the minimum distance between the winding finish point $P_2$ and the secondary transfer-drive roller 13 were set to be 0.5 mm or less, image irregularities occurred.

On the contrary, when both the minimum distances between the winding start point $P_1$ and the secondary transfer-drive roller 13, and the minimum distance between the winding finish point $P_2$ and the secondary transfer-drive roller 13 were set to be more than or equal to 1 mm, image irregularities were prevented.

However, the relationship between the appropriate minimum distance, and the angles $\theta_1$ and $\theta_2$ varies depending on the curvature of the pressure roller 24 and the secondary transfer-drive roller 13.

As a reference, the relationship between the appropriate minimum distance h, and the angles $\theta_1$ and $\theta_2$ is represented by the following equations. When indicating either $\theta_1$ or $\theta_2$, a symbol θ is used.

$$R \sin\theta=(r+h)\sin\alpha \tag{12}$$

$$R \cos\theta+(r+h)\cos\theta=R+r \tag{13}$$

When Equations 12 and 13 are modified, the following equations are obtained.

$$\sin\alpha=R \sin\theta/(r+h) \tag{14}$$

$$\cos\alpha=(R+r-R \cos\theta)/(r+h) \tag{15}$$

The following equation can be obtained according to an equation $\sin^2\alpha+\cos^2\alpha=1$.

$$((R \sin\theta)/(r+h))^2+((R+r-R \cos\theta)/(r+h))^2=1 \tag{16}$$

When $\cos\theta=\sqrt{(1-\sin^2\theta)}$ is substituted, the following equation is obtained.

$$((R \sin\theta)/(r+h))^2+((R+r-R\sqrt{(1-\sin^2\theta)}/(r+h))^2=19 \tag{17}$$

When Equation 17 is organized in terms of sin θ, the following equation is obtained.

$$\sin\theta=\sqrt{(4R^2(R+r)^2-((R^2+(R+r)^2-(r+h)^2))^2/2R(R+r)} \tag{18}$$

The printer according to the exemplary embodiment uses the pressure roller 24 having a high stiffness. The stiffness herein refers to a stiffness which can resist against wrinkles generated in the transfer-fixing belt 21.

The pressure roller 24 using a material such as metal, hard resin, ceramic, and hard rubber may be considered as having a high stiffness.

A conductive material may be dispersed on the surface of the above materials or within the materials so that these materials may serve as an electrode which performs electrostatic transfer when needed.

When using a pressure member which does not perform the surface movement, but causes the transfer-fixing belt 21 to slidably move, instead of the pressure roller 24, the surface of the pressure member has mirror finishing, or the surface is coated with a fluoroethylene resin or a lubricant such as a silicone oil in order to enhance slippage relative to the transfer-fixing belt 21.

When the pressure member has a relatively large heat capacity, it may take time to heat the transfer-fixing belt 21. Therefore, it is not preferable.

In addition, when the coefficient of thermal expansion of the pressure member is relatively large, it is difficult to maintain a certain accuracy of the secondary transfer nip.

Therefore, a smaller heat capacity and thermal expansion are advantageous. It is desirable that a pressure member is in a form of a thin plate having a necessary strength.

For this reason, in a case of the sliding type, it is desirable to use a metal plate or a ceramic plate.

Next, a description will be given of a printer according to another exemplary embodiment. Unless otherwise specified, a structure of the printer according to another exemplary embodiment is similar to, if not the same as, the structure of the above-described printer.

Figure 8:
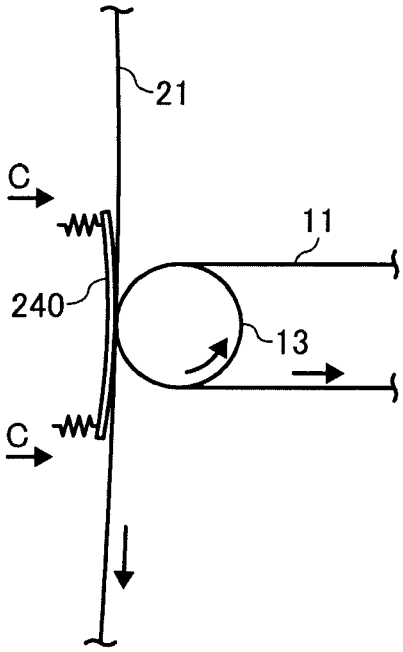
FIG. 8 is a schematic diagram illustrating the secondary transfer nip and the peripheral structure thereof according to exemplary embodiments.

Referring now to FIG. 8, there is provided an enlarged view of the secondary transfer nip and a peripheral structure thereof in the printer according to another exemplary embodiment.

The printer of another exemplary embodiment uses a pressure plate 240 in a form of a plate member as a pressure member. The surface thereof over which the transfer-fixing belt 21 is laid is curved at a certain curvature.

The end portions of the upstream and downstream of the pressure plate 240 in the belt traveling direction of the transfer-fixing belt 21 are each biased by pressure springs against the intermediate transfer belt 11.

According to the exemplary embodiment, the surface of the pressure plate 240 over which the transfer-fixing belt 21 is laid is curved at a certain curvature while the pressure plate 240 has a substantially flat shape.

Accordingly, though a portion thereof on which the belt is laid is curved at a certain curvature, a reduction in the size of the printer is achieved when compared with using a pressure roller having an equal curvature and an endless curved surface.

The radius of the curvature of the pressure plate 240 is greater than the radius of the curvature of the secondary transfer-drive roller 13. The transfer-fixing belt 21 is gently laid along the pressure plate 240.

When using the pressure plate 240 having such a moderate curvature, it is made possible to configure the traveling direction of the transfer-fixing belt 21 in the vicinity of the nip to be substantially perpendicular to the pressure direction, that is, a direction shown by an arrow C as shown in FIG. 8.

Furthermore, it is made possible to easily extend the above-described minimum distance h up to a certain distance which may prevent the image irregularities caused by belt waving or wrinkles in the vicinity of the secondary transfer nip.

Figure 9:
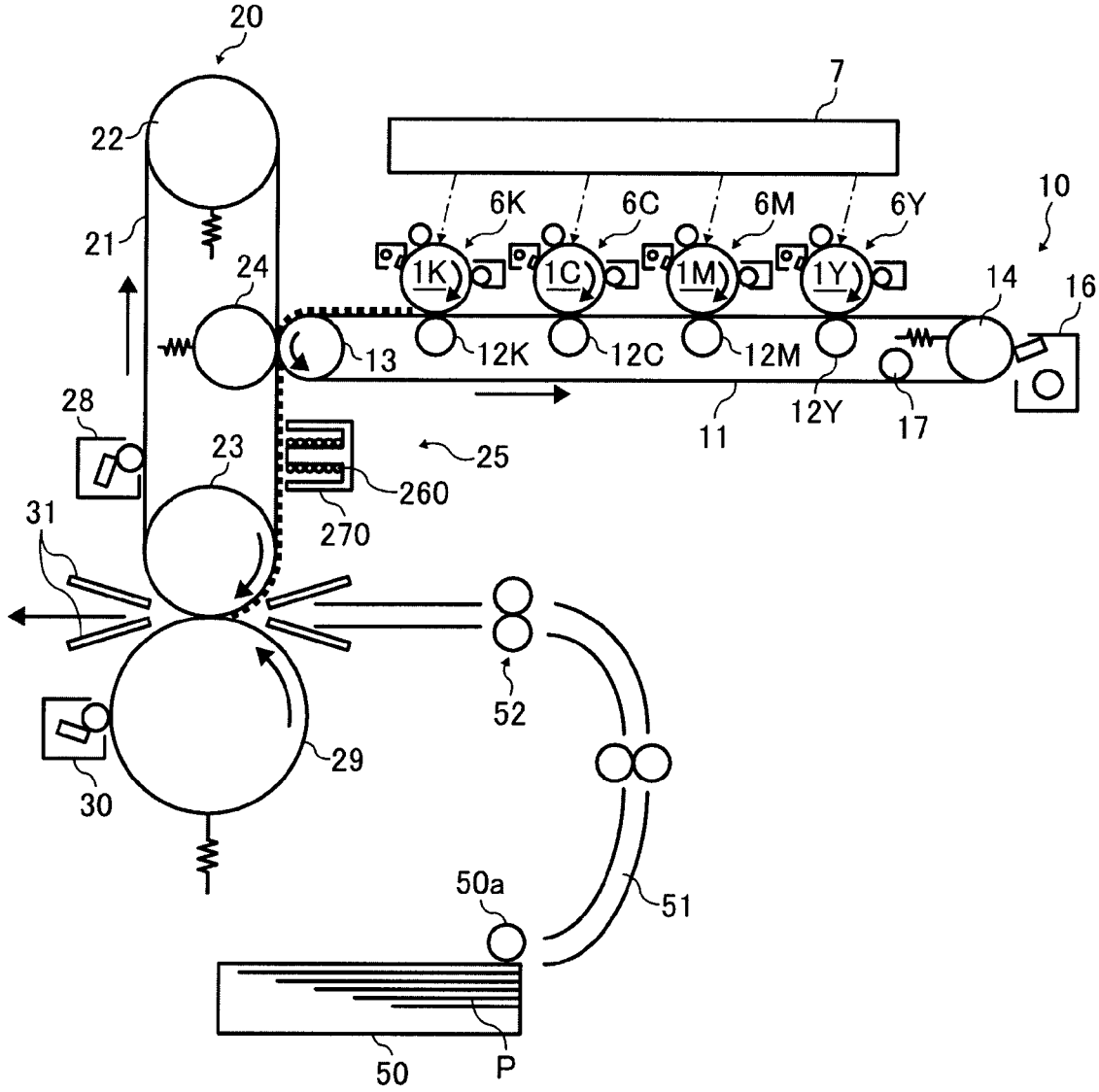
FIG. 9 is a schematic diagram illustrating the image forming apparatus according to another exemplary embodiment.

Referring now to FIG. 9, there is provided a schematic diagram according to still another exemplary embodiment.

The printer according to still another exemplary embodiment uses an electromagnetic induction type heater as the heating unit 25 which heats the toner image on the transfer-fixing belt 21 from the front surface of the transfer-fixing belt 21.

The heating unit 25 is disposed facing the front surface of the transfer-fixing belt 21. A predetermined gap is provided between the heating unit 25 and the front surface of the transfer-fixing belt 21.

The heating unit 25 includes coils 260 and a core 270 which holds the coils 260. An intense electric field is formed between the heating unit 25 and the transfer-fixing belt 21.

The belt base of the transfer-fixing belt 21 or another layer thereof is formed of metal so that the transfer-fixing belt 21 serves as an induction heating element which generates heat in the intense electric field formed by the heating unit 25.

Accordingly, it is made possible for the transfer-fixing belt 21 to generate heat by itself without relying on radiation or heat conduction.

Figure 10:
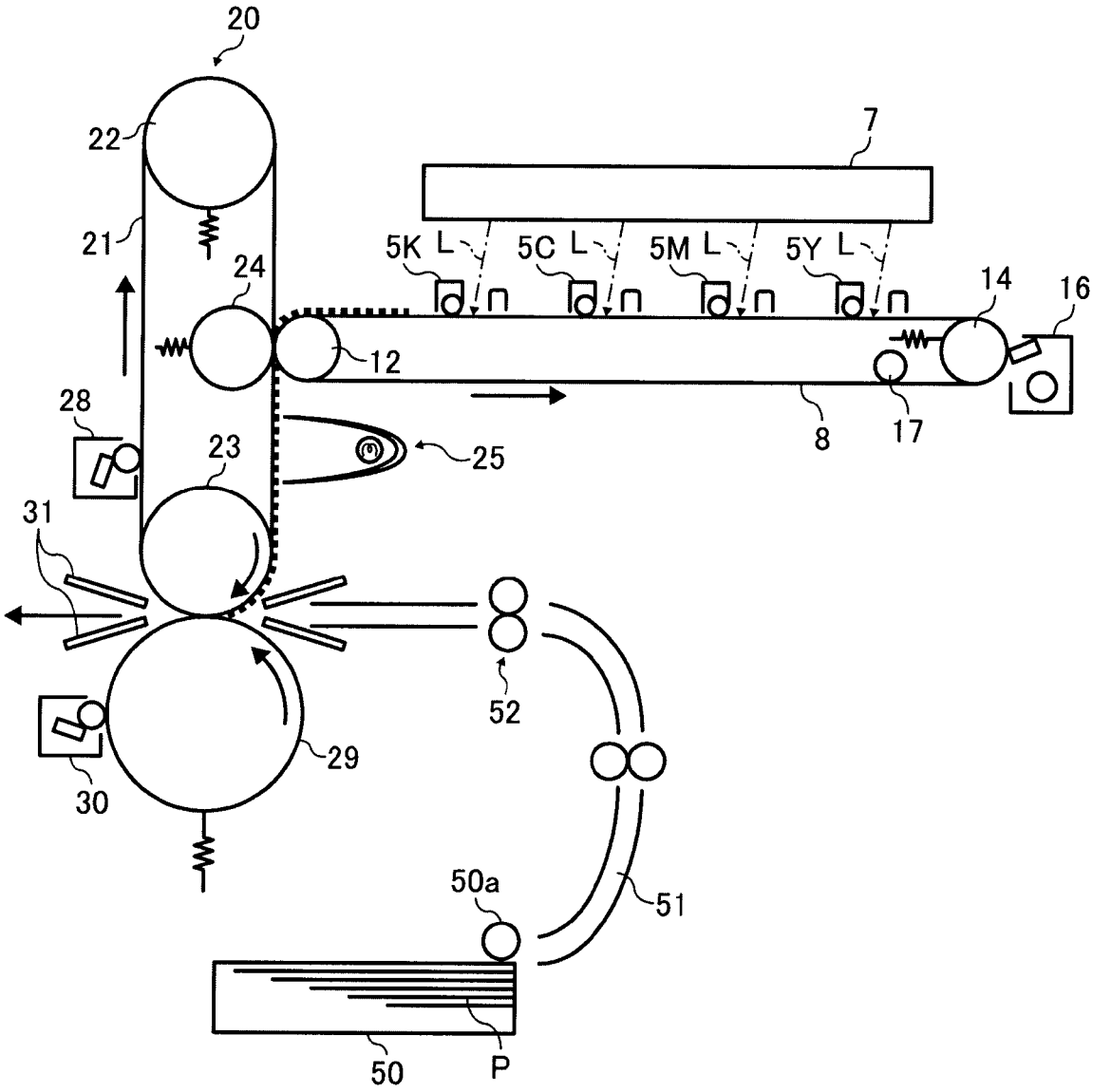
FIG. 10 is a schematic diagram illustrating the image forming apparatus according to still another exemplary embodiment.

Referring now to FIG. 10, there is provided a schematic diagram illustrating a printer according to still another exemplary embodiment.

The printer at least includes a photosensitive belt 8 and developing units 5Y, 5M, 5C and 5K for yellow, magenta, cyan and black, respectively, instead of a combination of process units for each color and intermediate transfer units.

The endless photosensitive belt 8 is stretchedly arranged between the primary transfer-drive roller 12 and the tension roller 14, and endlessly travels in a counter-clockwise direction.

Above the front surface of the spanned photosensitive belt 8 traveling horizontally are arranged the developing units 5Y, 5M, 5C and 5K along the belt traveling direction.

The photosensitive belt 8 presses the transfer-fixing belt 21 at a position where the transfer-fixing belt 21 is laid on the pressure roller 24. Accordingly, a primary transfer nip is formed.

Contact-separation mechanisms (not shown) each cause the developing units 5Y, 5M, 5C and 5K to come into contact with and to separate from the photosensitive belt 8.

Furthermore, a contact-separation mechanism (not shown) causes the fixing pressure roller 29 which forms the transfer-fixing nip by coming into contact with the transfer-fixing belt 21 to come into contact with and separate from the transfer-fixing belt 21.

When printing the four-color image, the above-described contact-separation mechanism causes the fixing pressure roller 29 to separate from the transfer-fixing belt 21.

Subsequently, the optical writing unit 7 writes an electrostatic latent image on the front surface of the photosensitive belt 8.

At a substantially same timing of writing, the above-described contact-separation mechanism causes the developing unit 5Y among the developing units 5Y, 5M, 5C and 5K to come into contact with the photosensitive belt 8.

The electrostatic latent image of yellow is developed by the developing unit 5Y so that a yellow toner image is developed.

The yellow toner image is primarily transferred on the transfer-fixing belt 21 at the primary transfer nip where the photosensitive belt 8 and the transfer-fixing belt 21 come into contact with each other.

Similarly, toner images of magenta, cyan and black are formed on the photosensitive belt 8. Subsequently, the toner images of magenta, cyan and black are sequentially overlaid on one another and are primarily transferred on the transfer-fixing belt 21. Accordingly, a four-color toner image is formed on the transfer-fixing belt 21.

When the primary transfer of the four-color toner image is finished, the contact-separation mechanism causes the fixing pressure roller 29 to come into contact with the transfer-fixing belt 21. Accordingly, the transfer-fixing nip is formed.

Subsequently, the four-color toner image is secondarily transferred at once on the recording sheet P and is fixed in the transfer-fixing nip.

The descriptions have been given of the exemplary embodiments of the present invention applied to a printer using an electrophotographic method.

However, the present invention may be applied to an image forming apparatus which forms an image using a direct recording method disclosed in a related art, for example, Japanese Patent Laid-open Application Publication No. 2002-307737.

The direct recording method refers to a method in which a toner group dispersed in a form of a dot from a toner dispersion unit is directly adhered to an intermediate recording medium to create a pixel image.

Accordingly, a toner image is directly formed on a recording medium and an intermediate recording medium.

The printer according to the above-described exemplary embodiments uses the pressure roller 24 or the pressure plate 240 serving as a pressure member which causes the curved surface thereof curved at a certain curvature to come into contact with the transfer-fixing belt 21.

According to the exemplary embodiments, an edge of the pressure member does not come into contact with the transfer-fixing roller 21. Therefore, a damage to the transfer-fixing belt 21 caused by the edge touching the transfer-fixing belt 21 is reduced, if not prevented.

Furthermore, according the printer of the exemplary embodiments, the following condition is satisfied:

$$T_1 \sin \theta_1 + T_2 \sin \theta_2 < 2.5 \times S,$$

where $\theta_1$ is an angle between the first virtual line segment $L_1$ and the third virtual line segment $L_3$; $\theta_2$ is an angle between the second line segment $L_2$ and the third line segment $L_3$; $S[cm^2]$ is an area of the secondary transfer nip; $T_1[N]$ is a tension in the vicinity of the winding start point $P_1$ of the transfer-fixing belt 21 in the resting state; and $T_2$ [N] is a tension in the vicinity of the winding finish point $P_2$ of the transfer-fixing belt 21 in the resting state.

The first virtual line segment $L_1$ is a line segment extending from the winding start point $P_1$ to a center Pa of the virtual circle having the same curvature as that of the pressure roller.

$P_1$ is a start point of a belt winding of the transfer-fixing belt 21 which endlessly travels relative to the curved surface of the pressure member.

The third virtual line segment $L_3$ is a line segment extending from the center point Pc of the secondary transfer nip in the belt traveling direction to the center of the virtual circle.

The second virtual line segment $L_2$ is a line segment extending from the winding finish point $P_2$ to the center of the virtual circle.

$P_2$ is a finish point of a belt winding of the transfer-fixing belt 21 relative to the pressure member.

According to the exemplary embodiments, when the transfer-fixing belt 21 is laid on the curved surface of the pressure member, and the angles $\theta_1$ and $\theta_2$ are set to more than or equal to 0 degrees, it is possible to suppress the hollow defect in a print image.

In the printer according to the exemplary embodiments, the winding start point $P_1$ is positioned further upstream in the belt traveling direction of the transfer-fixing belt 21 than the transfer nip entrance point where the intermediate transfer belt 11 or the photosensitive belt 8 serving as an image carrier and the endlessly-traveling transfer-fixing belt 21 start to come into contact.

According to the exemplary embodiments, when compared with a case in which the winding start point $P_1$ is the transfer nip entrance point, image irregularities caused by belt waving or wrinkles in the vicinity of the secondary transfer nip entrance is reduced, if not prevented.

In the printer according to the exemplary embodiments, the winding finish point $P_2$ is positioned further downstream in the belt traveling direction of the transfer-fixing belt 21 than the transfer nip exit point where the intermediate transfer belt 11 or the photosensitive belt 8 and the endlessly-traveling transfer-fixing belt 21 start to separate from each other after passing the secondary transfer nip.

According to the exemplary embodiments, when compared with a case in which the winding finish point $P_2$ is the transfer nip finish point, image irregularities caused by belt waving or wrinkles in the vicinity of the secondary transfer nip exit is reduced, if not prevented.

In the printer according to the exemplary embodiments, the pressure plate 240 in the form of a plate member which curves at a certain curvature is used as a pressure member.

When compared with a pressure roller having the same curvature and an endless curved surface, reduction of the printer size is achieved.

In the printer according to the exemplary embodiments, a pressure member having a high stiffness is used.

Accordingly, a deformation of the pressure member caused by the stress due to wrinkles generated in the transfer-fixing belt 21 is reduced, if not prevented.

Therefore, the fluctuation of the secondary transfer nip pressure caused by the deformation of the pressure member is reduced, if not prevented.

Furthermore, elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, system, computer program and computer program product. For example, any of the aforementioned methods may be embodied in the form of a system or device, including, but not limited to, any of the structure for performing the methodology illustrated in the drawings.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable media and is adapted to perform any one of the aforementioned methods, when run on a computer device (a device including a processor).

The program may include computer executable instructions for carrying one or more of the steps above and/or more aspects of the invention.

Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of a built-in medium include, but are not limited to, rewriteable non-volatile memories, such as ROMs and flash memories, and hard disks.

Examples of a removable medium include, but are not limited to, optical storage media such as CD-ROMs and DVDs; magneto-optical storage media, such as MOs; magnetism storage media, such as Floppy Disks™, cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An image forming apparatus, comprising:

an image carrier configured to travel in an endless loop and including a surface configured to bear a visible image;

an endless transfer-fixing belt stretchedly arranged between at least two spanning members, wherein the endless transfer-fixing belt has a substantially flat front surface formed between the at least two spanning members, the endless transfer-fixing belt being configured to contact the image carrier via the front surface to form a transfer nip while contacting another member other than the image carrier to form a transfer-fixing nip;

a pressure member configured to press the front surface of the transfer-fixing belt to the image carrier while contacting a backside of the front surface of the transfer-fixing belt at the transfer nip, the pressure member being located between the at least two spanning members relative to the backside of the front surface of the transfer-fixing belt; and a heater configured to heat the visible image;

the image carrier is further configured to transfer the visible image onto the front surface of the transfer-fixing belt at the transfer nip, and the transfer-fixing belt is further configured to transport the visible image to the transfer-fixing nip while heated by the heater, and to transfer and fix the visible image on a recording member; and the transfer-fixing belt is stretchedly arranged such that the transfer-fixing belt travels in a direction substantially perpendicular to a pressure direction of the pressure member in a proximity of the transfer nip, wherein the pressure member comprises a curved surface having a curvature and contacting the transfer-fixing belt, and the image forming apparatus is further configured to satisfy the following relationship:

$$T_1 \sin \theta_1 + T_2 \sin \theta_2 < 2.5 \times S,$$

wherein $\theta_1$ is an angle between a first virtual line segment $L_1$ extending from a winding start point $P_1$ of the transfer-fixing belt relative to the curved surface of the pressure member to a center of a virtual circle having the same curvature as that of the curved surface, the virtual circle being drawn along a curved direction of the curved surface, and a third virtual line segment $L_3$ extending from the center point of the transfer nip in a belt traveling direction of the transfer-fixing belt to the center of the virtual circle; $\theta_2$ is an angle between a second line segment $L_2$ extending from a winding finish point $P_2$ of the transfer-fixing belt relative to the pressure member to the center of the virtual circle and the third line segment $L_3$; S is an area of the transfer nip; $T_1$ is a tension near the winding start point $P_1$ of the transfer-fixing belt in a resting state; and $T_2$ is a tension near the winding finish point $P_2$ of the transfer-fixing belt in the resting state.

2. The image forming apparatus according to claim 1, wherein the winding start point $P_1$ is disposed further upstream in the belt traveling direction of the transfer-fixing belt than a transfer nip entrance point where the image carrier and the transfer-fixing belt start contacting each other.

3. The image forming apparatus according to claim 1, wherein the winding finish point $P_2$ is disposed further downstream in the belt traveling direction of the transfer-fixing belt than a transfer nip exit point where the image carrier and the transfer-fixing belt start separating from each other after passing the transfer nip.

4. The image forming apparatus according to claim 1, wherein the pressure member is a plate-shaped member curved at a curvature.

5. The image forming apparatus according to claim 1, wherein the pressure member is formed of a material having a high stiffness.

6. The image forming apparatus according to claim 1, wherein the at least two spanning members includes only two spanning members and one of the two spanning members forms one side of the transfer-fixing nip.

7. A method for forming an image with an image forming apparatus, the method comprising:

transferring a visible image to a surface of an image carrier;

forming a transfer nip by contacting the image carrier with a front surface of an endless transfer-fixing belt stretchedly arranged between at least two spanning members, wherein the front surface is a substantially flat surface formed between the at least two spanning members;

forming a transfer-fixing nip by contacting another member other than the image carrier with the front surface of the endless transfer-fixing belt;

pressing, via a pressure member, the front surface of the transfer-fixing belt to the image carrier in a pressure direction by contacting a backside of the front surface of the transfer-fixing belt at the transfer nip, the pressure member being located between the at least two spanning members relative to the backside of the front surface of the transfer-fixing belt;

transferring the visible image from the image carrier onto the front surface of the transfer-fixing belt at the transfer nip;

heating the visible image;

transporting the visible image to the transfer-fixing nip during the heating of the visible image;

transferring and fixing the visible image on a recording member; and moving the transfer-fixing belt in a direction substantially perpendicular to the pressure direction at the transfer nip, wherein the pressure member includes a curved surface having a curvature and contacting the transfer-fixing belt, and the image forming apparatus is configured to satisfy the following relationship:

$$T_1 \sin \theta_1 + T_2 \sin \theta_2 < 2.5 \times S,$$

wherein $\theta_1$ is an angle between a first virtual line segment $L_1$ extending from a winding start point $P_1$ of the transfer-fixing belt relative to the curved surface of the pressure member to a center of a virtual circle having the same curvature as that of the curved surface, the virtual circle being drawn along a curved direction of the curved surface, and a third virtual line segment $L_3$ extending from the center point of the transfer nip in a belt traveling direction of the transfer-fixing belt to the center of the virtual circle; $\theta_2$ is an angle between a second line segment $L_2$ extending from a winding finish point $P_2$ of the transfer-fixing belt relative to the pressure member to the center of the virtual circle and the third line segment $L_3$; S is an area of the transfer nip; $T_1$ is a tension near the winding start point $P_1$ of the transfer-fixing belt in a resting state; and $T_2$ is a tension near the winding finish point $P_2$ of the transfer-fixing belt in the resting state.

* * * * *